US005826784A

United States Patent [19]

Wojcik

[11] Patent Number: 5,826,784

[45] Date of Patent: Oct. 27, 1998

[54] FAST FOOD BOX TRAY

[76] Inventor: James J. Wojcik, 7214 Lamplite Ct., Cincinnati, Ohio 45244-4110

[21] Appl. No.: 985,325

[22] Filed: Dec. 4, 1997

[51] Int. Cl.[6] ..... B65D 5/42

[52] U.S. Cl. ..... 229/125; 229/114; 229/902

[58] Field of Search ..... 229/114, 125, 229/120.09, 120.17, 125.11, 902, 906; 220/4.24, 4.25, 334, 335

[56] References Cited

U.S. PATENT DOCUMENTS

| | | | |
|---|---|---|---|
| 1,083,403 | 1/1914 | Joslin | 229/125 |
| 1,762,900 | 6/1930 | Todd | 229/125 |
| 3,713,578 | 1/1973 | Johnson | 229/125 |
| 4,762,272 | 8/1988 | Herrin | 229/125.11 |
| 5,039,003 | 8/1991 | Gordon et al. | 229/114 |
| 5,261,533 | 11/1993 | Adams et al. | 229/120.09 |
| 5,538,179 | 7/1996 | Cai | 229/125 |

*Primary Examiner*—Gary E. Elkins

[57] ABSTRACT

A new fast food box tray for preventing spills when placed on a user's lap. The inventive device includes a bottom tray. A top tray is foldably secured to an upper edge of the bottom tray. A rigidifying member is extendable between the top tray and the bottom tray in an open orientation.

6 Claims, 2 Drawing Sheets

FAST FOOD BOX TRAY

BACKGROUND OF THE INVENTION

1. Field of the Invention

The present invention relates to food storage containers and more particularly pertains to a new fast food box tray for preventing spills when placed on a user's lap.

2. Description of the Prior Art

The use of food storage containers is known in the prior art. More specifically, food storage containers heretofore devised and utilized are known to consist basically of familiar, expected and obvious structural configurations, notwithstanding the myriad of designs encompassed by the crowded prior art which have been developed for the fulfillment of countless objectives and requirements.

Known prior art food storage containers include U.S. Pat. No. 4,576,330 to Schepp; U.S. Pat. No. 5,242,106 to Gulliver; U.S. Pat. No. Des. 355,814 to Van Valkenburg et al.; U.S. Pat. No. 5,267,686 to Gulliver et al.; U.S. Pat. No. Des. 253,514 to Etelson; and U.S. Pat. No. 5,429,833 to Wyslotsky.

While these devices fulfill their respective, particular objectives and requirements, the aforementioned patents do not disclose a new fast food box tray. The inventive device includes a bottom tray. A top tray is foldably secured to an upper edge of the bottom tray. A rigidifying member is extendable between the top tray and the bottom tray in an open orientation.

In these respects, the fast food box tray according to the present invention substantially departs from the conventional concepts and designs of the prior art, and in so doing provides an apparatus primarily developed for the purpose of preventing spills when placed on a user's lap.

SUMMARY OF THE INVENTION

In view of the foregoing disadvantages inherent in the known types of food storage containers now present in the prior art, the present invention provides a new fast food box tray construction wherein the same can be utilized for preventing spills when placed on a user's lap.

The general purpose of the present invention, which will be described subsequently in greater detail, is to provide a new fast food box tray apparatus and method which has many of the advantages of the food storage containers mentioned heretofore and many novel features that result in a new fast food box tray which is not anticipated, rendered obvious, suggested, or even implied by any of the prior art food storage containers, either alone or in any combination thereof.

To attain this, the present invention generally comprises a bottom tray having an open upper end, a closed bottom end, a front wall, a back wall and opposed side walls. A top tray is provided having a closed upper end, an open bottom end, a front wall, a back wall and opposed side walls. A lower edge of the open bottom end at the back wall is foldably secured to an upper edge of the open upper end of the bottom tray at the back wall thereof. The back wall of the top tray has a vertically disposed semi-adherent strip extending between the closed upper end and the open bottom end of the top tray. A tape portion is extendable between the closed upper end of the top tray and the closed bottom end of the bottom tray in an open orientation. The tape portion includes a fixed portion and a releasable portion. The fixed portion is fixedly secured to the closed upper end of the top tray. The releasable portion removably adheres to the semi-adherent strip of the back wall of the top tray in a closed orientation whereby the releasable portion can be peeled off of the semi-adherent strip and secured to the closed bottom end of the bottom tray whereby the closed upper end of the top tray and the closed bottom end of the bottom tray are disposed on the same plane.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new fast food box tray apparatus and method which has many of the advantages of the food storage containers mentioned heretofore and many novel features that result in a new fast food box tray which is not anticipated, rendered obvious, suggested, or even implied by any of the prior art food storage containers, either alone or in any combination thereof.

It is another object of the present invention to provide a new fast food box tray which may be easily and efficiently manufactured and marketed.

It is a further object of the present invention to provide a new fast food box tray which is of a durable and reliable construction.

An even further object of the present invention is to provide a new fast food box tray which is susceptible of a low cost of manufacture with regard to both materials and labor, and which accordingly is then susceptible of low prices of sale to the consuming public, thereby making such fast food box tray economically available to the buying public.

Still yet another object of the present invention is to provide a new fast food box tray which provides in the apparatuses and methods of the prior art some of the advantages thereof, while simultaneously overcoming some of the disadvantages normally associated therewith.

Still another object of the present invention is to provide a new fast food box tray for preventing spills when placed on a user's lap.

Yet another object of the present invention is to provide a new fast food box tray which includes a bottom tray. A top tray is foldably secured to an upper edge of the bottom tray. A rigidifying member is extendable between the top tray and the bottom tray in an open orientation.

Still yet another object of the present invention is to provide a new fast food box tray that stabilizes fast-food in situations where tables would not be accessible.

Even still another object of the present invention is to provide a new fast food box tray that is ideal for individuals who order their food through drive-through windows.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
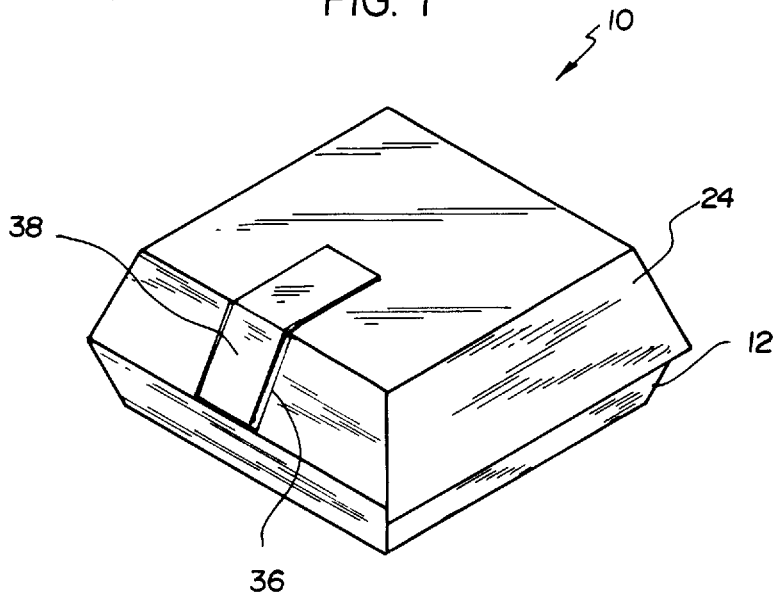
FIG. 1 is a perspective view of a new fast food box tray according to the present invention.
Figure 2:
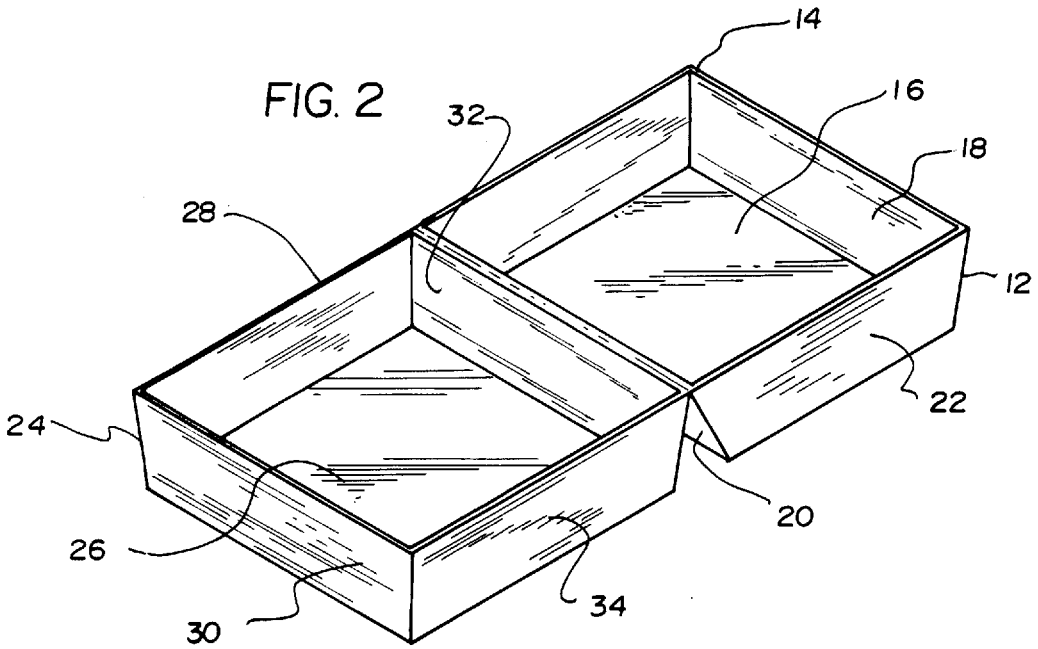
FIG. 2 is a perspective view of the present invention illustrated in an open orientation.
Figure 3:
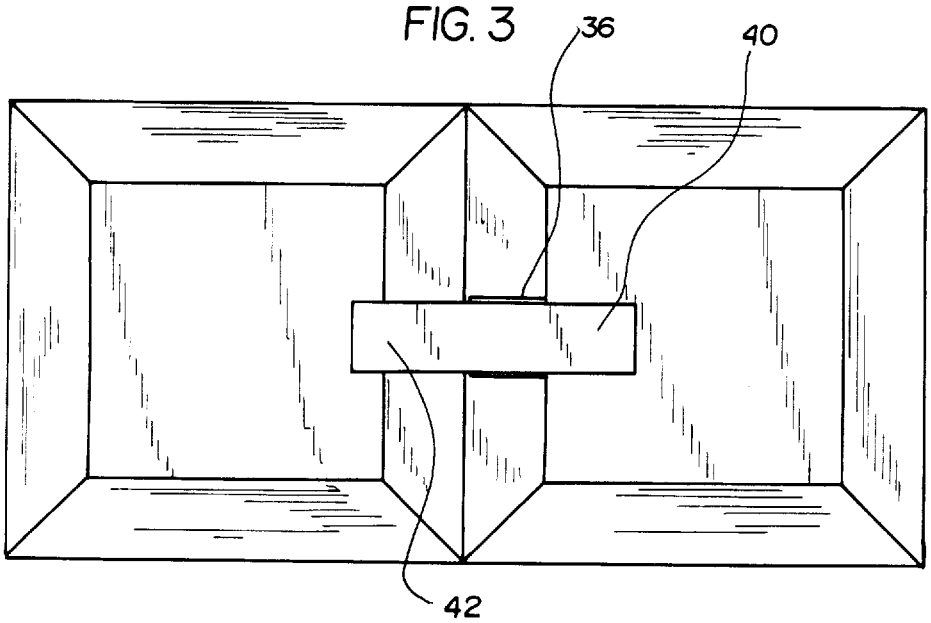
FIG. 3 is a bottom plan view of the present invention illustrated in the open orientation.
Figure 4:
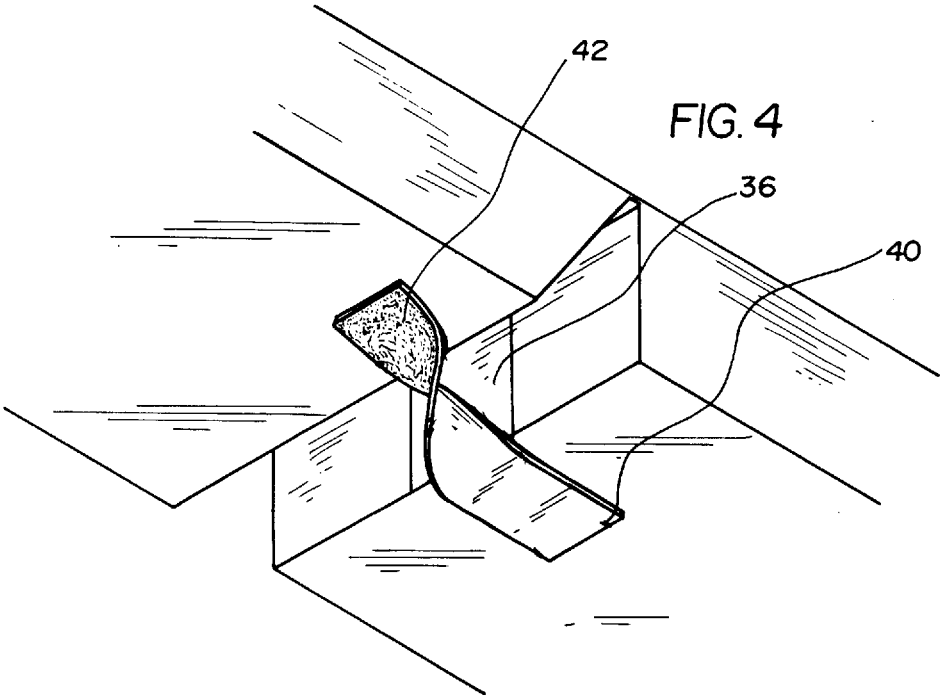
FIG. 4 is a sectional bottom view of the present invention illustrating the tape portion thereof.

With reference now to the drawings, and in particular to FIGS. 1 through 4 thereof, a new fast food box tray embodying the principles and concepts of the present invention and generally designated by the reference numeral 10 will be described.

As best illustrated in FIGS. 1 through 4, the fast food box tray 10 comprises a bottom tray 12 having an open upper end 14, a closed bottom end 16, a front wall 18, a back wall 20 and opposed side walls 22. The bottom tray 12 will generally hold a sandwich or the like therein.

A top tray 24 is provided having a closed upper end 26, an open bottom end 28, a front wall 30, a back wall 32 and opposed side walls 34. A lower edge of the open bottom end 28 at the back wall 32 is foldably secured to an upper edge of the open upper end 14 of the bottom tray 12 at the back wall 20 thereof. The back wall 32 of the top tray 24 has a vertically disposed semi-adherent strip 36 extending between the closed upper end 26 and the open bottom end 28 of the top tray 24.

A tape portion 38 is extendable between the closed upper end 26 of the top tray 24 and the closed bottom end 16 of the bottom tray 12 in an open orientation. Alternately, any other type of tension carrying apparatus could be used in place of the tape portion 38. Note FIG. 3. The tape portion 38 includes a fixed portion 40 and a releasable portion 42. The fixed portion 40 is fixedly secured to the closed upper end 26 of the top tray 24. The releasable portion 42 removably adheres to the semi-adherent strip 36 of the back wall 32 of the top tray 24 in a closed orientation whereby the releasable portion 42 can be peeled off of the semi-adherent strip 36 and secured to the closed bottom end 16 of the bottom tray 12 whereby the closed upper end of the top tray 24 and the closed bottom end of the bottom tray 12 are disposed on the same plane.

In use, the user would simply remove the releasable portion 42 of the tape portion 38, open the top tray 24 with respect to the bottom tray 12, and place the releasable portion 42 on the closed bottom end 16 of the bottom tray 12. The tape portion 38 would allow the user to place the trays 12,24 in an open orientation on their lap without it bending at the hinge. The device 10 allows food to be placed in both the top tray 24 and the bottom tray 12 without spillage. The tape portion 38 would prevent the top tray 24 and the bottom tray 12 from over extending beyond the common plane when in the open orientation. This will prevent any unwanted spills. The device 10 would be ideal while eating fast-food in an automobile, on a bench, and in other areas where tables are not accessible. The device 10 would prevent spills and messy eating while riding in a vehicle.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A fast food box tray for preventing spills when placed in a user's lap comprising, in combination:

a bottom tray having an open upper end, a closed bottom end, a front wall, a back wall and opposed side walls;

a top tray having a closed upper end, an open bottom end, a front wall, a back wall and opposed side walls, a lower edge of the open bottom end at the back wall foldably secured to an upper edge of the open upper end of the bottom tray at the back wall thereof, the back wall of the top tray having a vertically disposed semi-adherent strip extending between the closed upper end and the open bottom end of the top tray; and a tape portion extendable between the closed upper end of the top tray and the closed bottom end of the bottom tray in an open orientation, the tape portion including a fixed portion and a releasable portion, the fixed portion fixedly secured to the closed upper end of the top tray, the releasable portion removably adhering to the semi-adherent strip of the back wall of the top tray in a closed orientation whereby the releasable portion can be peeled off of the semi-adherent strip and secured to the closed bottom end of the bottom tray whereby the top tray and the bottom tray are disposed on the same plane.

2. A fast food box tray for preventing spills when placed in a user's lap comprising, in combination:

a bottom tray;

a top tray foldably secured to an upper edge of the bottom tray; and a tape portion extendable between a closed upper end of the top tray and a closed bottom end of the bottom tray in an open orientation.

3. The fast food box tray as set forth in claim 2 wherein the tape portion includes a fixed portion and a releasable portion.

4. The fast food box tray as set forth in claim 3 wherein the fixed portion is fixedly secured to the closed upper end of the top tray.

5. The fast food box tray as set forth in claim 4 wherein the releasable portion removably adheres to a semi-adherent strip on a back wall of the top tray in a closed orientation whereby the releasable portion can be peeled off of the semi-adherent strip and secured to the closed bottom end of the bottom tray whereby the closed upper end of the top tray and the closed bottom end of the bottom tray are disposed on the same plane.

6. A fast food box tray for preventing spills when placed in a user's lap comprising, in combination:

a bottom tray;

a top tray foldably secured to an upper edge of the bottom tray; and a member extending between the top tray and bottom tray which rigidifies the box tray in the open configuration.

* * * * *